US007810542B2

(12) United States Patent
Bonini

(10) Patent No.: US 7,810,542 B2
(45) Date of Patent: Oct. 12, 2010

(54) FLEXIBLE GUIDE FOR A MOSQUITO NET

(75) Inventor: Nardo Bonini, Campagnola Emilia (IT)

(73) Assignee: I.R.S. S.p.A., Campagnola Emilia (Reggio Emilia) (IT)

( * ) Notice: Subject to any disclaimer, the term of this patent is extended or adjusted under 35 U.S.C. 154(b) by 543 days.

(21) Appl. No.: 11/707,878

(22) Filed: Feb. 20, 2007

(65) Prior Publication Data

US 2007/0209767 A1 Sep. 13, 2007

(30) Foreign Application Priority Data

Feb. 24, 2006 (IT) ..... RE2006A0025

(51) Int. Cl.
*A47H 1/00* (2006.01)
*A47H 5/00* (2006.01)
*E05D 15/06* (2006.01)

(52) U.S. Cl. ..... 160/31; 160/84.06; 160/194

(58) Field of Classification Search ..... 160/84.06, 160/31, 194, 201, 240, 268.1, 271, 272, 277, 160/279; 474/204, 205, 206
See application file for complete search history.

(56) References Cited

U.S. PATENT DOCUMENTS 6,186,212 B1 * 2/2001 Tsuchida ..... 160/84.06
6,318,438 B1 * 11/2001 Uno et al. ..... 160/31
6,978,820 B2 * 12/2005 Aoki ..... 160/84.06
7,472,738 B2 * 1/2009 Kamosawa et al. ..... 160/84.06
2004/0185978 A1 * 9/2004 Prince ..... 474/206
2006/0162871 A1 * 7/2006 Kamosawa et al. ..... 160/84.06
2007/0039698 A1 * 2/2007 Chino et al. ..... 160/84.06
2007/0068633 A1 * 3/2007 Chino et al. ..... 160/31
2008/0053629 A1 * 3/2008 Moriya et al. ..... 160/272
2008/0135189 A1 * 6/2008 Okachi et al. ..... 160/84.06
2009/0020234 A1 * 1/2009 Chino et al. ..... 160/31

FOREIGN PATENT DOCUMENTS

EP 0 999 335 A1 5/2000

* cited by examiner

*Primary Examiner*—Katherine W Mitchell
*Assistant Examiner*—Jaime F Cardenas-Garcia
(74) *Attorney, Agent, or Firm*—Browdy and Neimark, PLLC

(57) ABSTRACT

A flexible guide (1) for a mosquito net (100) of a type which is fixable to a window opening, comprising a plurality of rigid adjacent links (2*a*, 2*b*, 200), in which each link (2*a*, 2*b* 200) exhibits a pair of opposite flanks (5*a*, 5*b*, 205) which between them receive the mosquito net (100), and a connecting portion (6, 206) arranged transversally and fixed to the flanks (5*a*, 5*b*), each link (2*a*, 2*b*, 200) being provided with a seating (4, 204) for receiving a flexible strap element (3, 203) in order to form, with adjacently-situated links (2*a*, 2*b*), a single chain.

15 Claims, 4 Drawing Sheets

FLEXIBLE GUIDE FOR A MOSQUITO NET

The invention relates to a flexible guide for a mosquito net.

The prior art describes mosquito nets comprising a winding roller located in a roller box fixed to a vertical upright of a window opening and a sliding activating bar, arranged opposite to one another, as well as a net mounted on two opposite sides respective to the roller and the activating bar, in order for the net to be opened and closed by activating the bar in a nearing or distancing direction to the roller.

The mosquito nets of the above-described type require special guides in which the activating bar runs, which receive the opposite free edges of the net when the net is in an at least partly-closed position.

Also known is that the use of fixed guides exhibits some drawbacks, in particular the lower fixed guide applied to a door-window constitutes a serious obstacle to the transit of trolleys or the like, as well as a danger for people who might trip over the guide.

To obviate the above drawback, the prior art includes mosquito nets in which the upper guide, of a traditional type, is fixed, while the lower guide is realised by means of an articulated chain, an end of which is fixed to the roller box while the other free end is inserted in a shaped cavity afforded in the activating bar expressly for housing the chain therein.

In particular, when the net is completely stretched in a closed position, closing the door-window opening, the activating bar is adjacent to the upright opposite the upright the roller box is fixed to, and the chain, after being drawn out of the cavity, is positioned on a slim profile afforded over the whole length of the base of the window opening. In this position only a few links of the chain remain in the shaped cavity of the activating bar.

When the mosquito net is opened, displacing the bar toward the roller box, the chain rises again inside the cavity of the bar, freeing the base of the window opening as well as the slim profile.

EP-A-0999335 describes a retractable flexible guide and an application thereof. The flexible guide is formed by a plurality of identical links, each comprising a first pair of parallel flanks provided with a hole and an arched small window close to the hole, and by a second pair of parallel flanks, joined to the flanks of the first pair and provided with a first pivot that projects externally and a second small pivot which inserts respective in the hole and in the small window. The flanks of the second pair are joined by a connecting portion which is perpendicular to the flanks themselves. The links are articulated, the flanks of the second pair being inserted between the flanks of the first pair of the adjacent link, and the pivots in the holes of the adjacent link.

The structure of the known flexible guides of the above-mentioned type is however relatively complicated as the links must be produced with small windows, holes, pivots and smaller pivots which require a certain precision during the realisation stage in order for the mechanical links allowing reciprocal rotation of the links to function correctly, without ever jamming.

Further, the pivots and small pivots are subject to wear and during the assembly process can even break.

An important fact is that the known-type guides cannot be subjected to excessive bending pressure, for example in order to achieve an angle close to 90°, limiting their use or in any case requiring special design adjustments to be made to the housing cavities afforded in the bar.

There is, therefore, a strong need to make available a flexible guide for mosquito nets which is simple and economical to realise, rapidly assemblable and which is hard-wearing and usable in extremely flexible ways.

The aim of the present invention is to provide a flexible guide for mosquito nets having structural and functional characteristics which satisfy the above-mentioned needs, while at the same time obviating the drawbacks mentioned herein above with reference to the prior art.

The aim is attained by a flexible guide for mosquito nets as set out in claim 1. The dependent claims delineate preferred and particularly advantageous embodiments of the flexible guide for mosquito nets of the invention.

Further characteristics and advantages of the invention will emerge from a reading of the following description, provided by way of non-limiting example with the aid of the figures illustrated in the appended drawings, in which.

Figure 11:
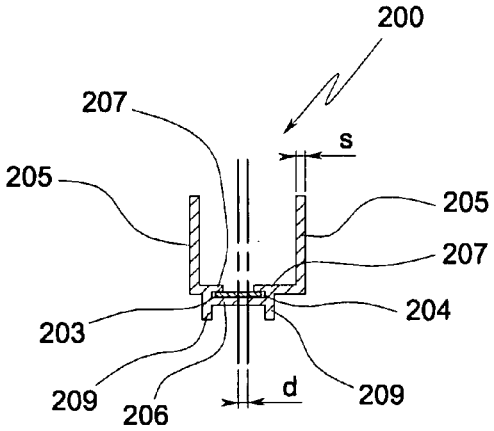
Figure 10:
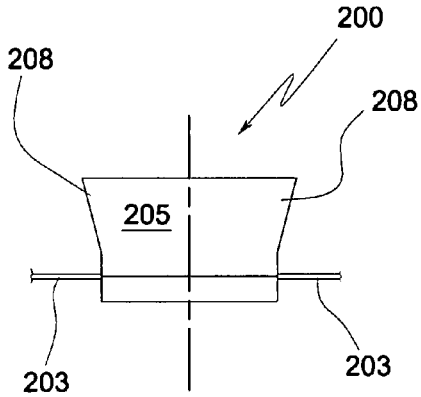

FIGS. 10 and 11 respectively show a lateral view and a section of a further embodiment of the chain link.

Figure 1:
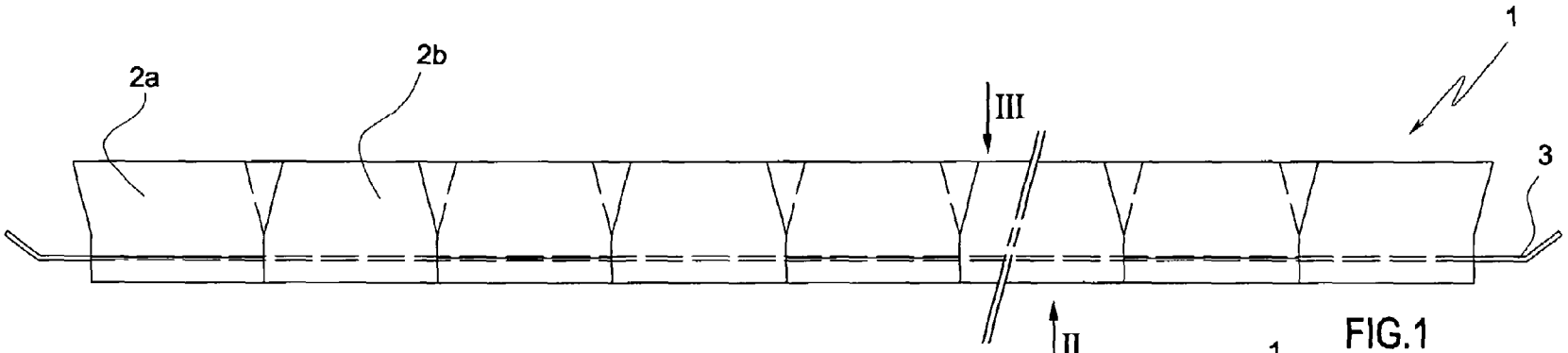
FIG. 1 is a lateral view of a flexible guide in agreement with the present invention.
Figure 2:
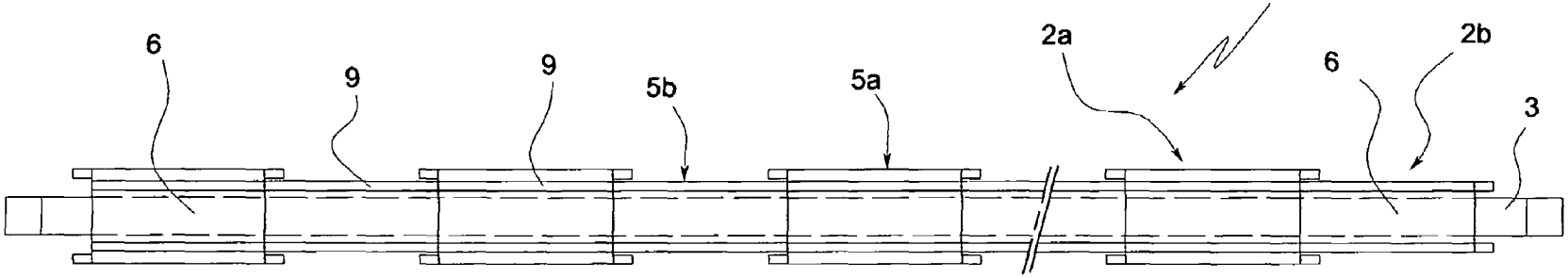
FIGS. 2 and 3 are views of the guide, respectively according to arrows II and III of FIG. 1.
Figure 3:
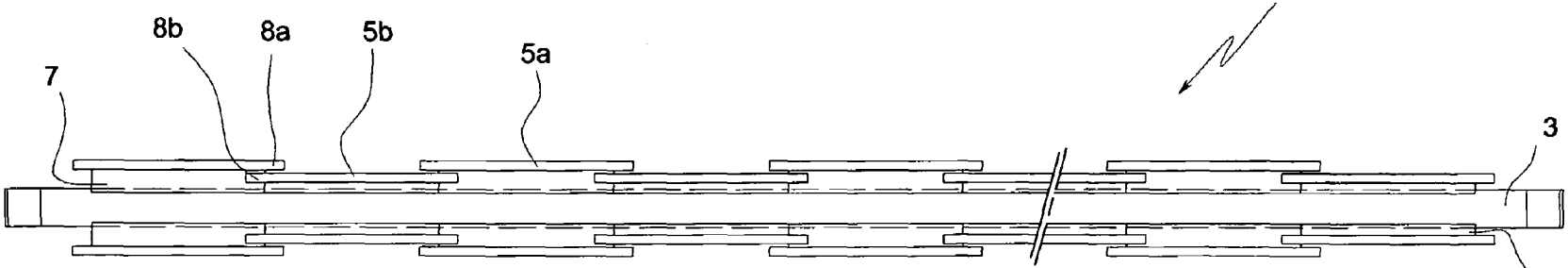

With reference to the figures of the drawings, 1 denotes in its entirety a flexible guide for a mosquito net 100 in agreement with the present invention. The guide 1 is made up of a plurality of first links 2*a*, and a plurality of second links 2*b* alternated with the first links 2*a*, which links 2*a* and 2*b* are interconnected to form a single chain (FIGS. 1-3).

In the present invention, the links 2*a* and 2*b* are hinged to one another to form a single chain by the sole use of a flexible strap element 3, in the example made of a non-stretching plastic material, which element 3 crosses through all the links 2*a*, 2*b*.

By strap element 3, in the present invention, any flexible element is intended, such as a wire, a band or the like.

Figure 6:
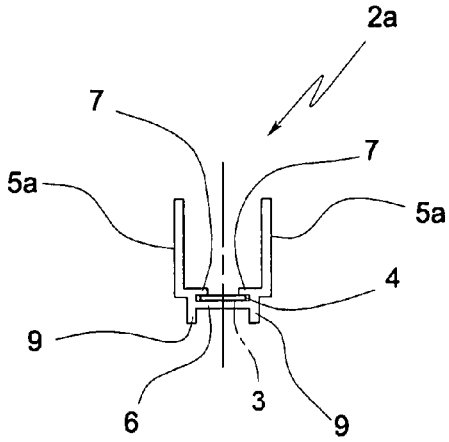
FIG. 6 is the link of FIG. 4 seen from arrow A.
Figure 7:
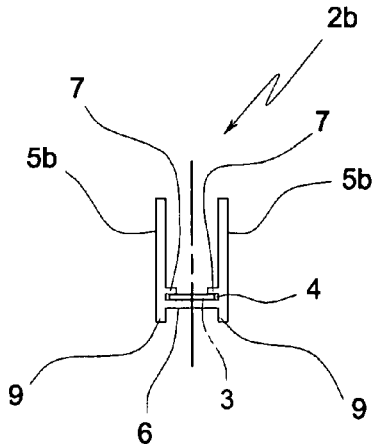
FIG. 7 is the link of FIG. 5 seen from arrow B.

As can clearly be seen in FIGS. 6 and 7, each link 2*a*, 2*b* is provided with a seating 4 in which the strap element 3 is slidably housed.

Each link 2*a* exhibits a pair of flanks 5*a* which are parallel and opposite and which are joined by a connecting portion 6 arranged perpendicular and interposed between the flanks 5*a* at the bases thereof.

Figure 8:
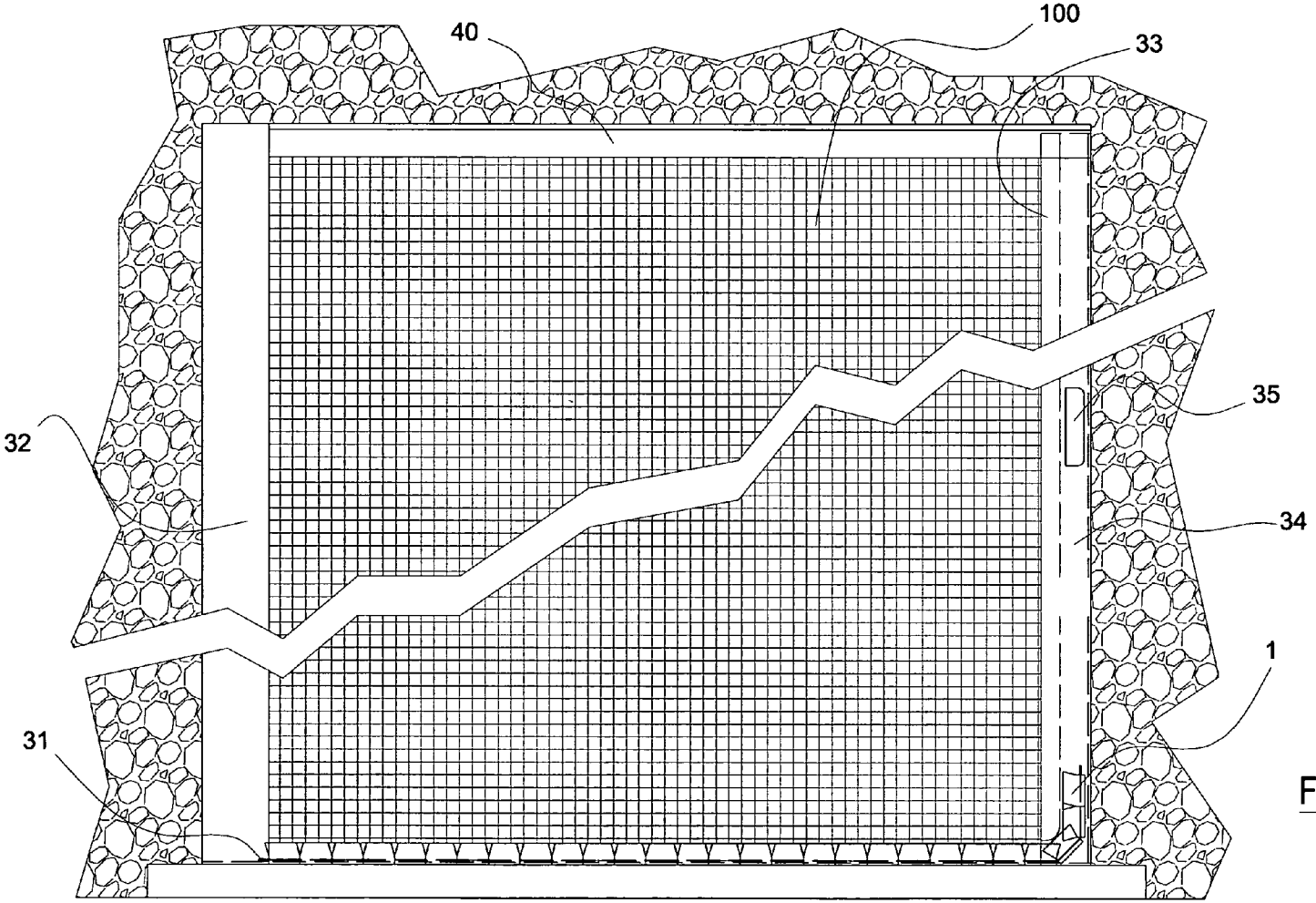
FIGS. 8 and 9 show a schematic view of a mosquito net applied to a door-window with a guide according to the present invention.
Figure 9:
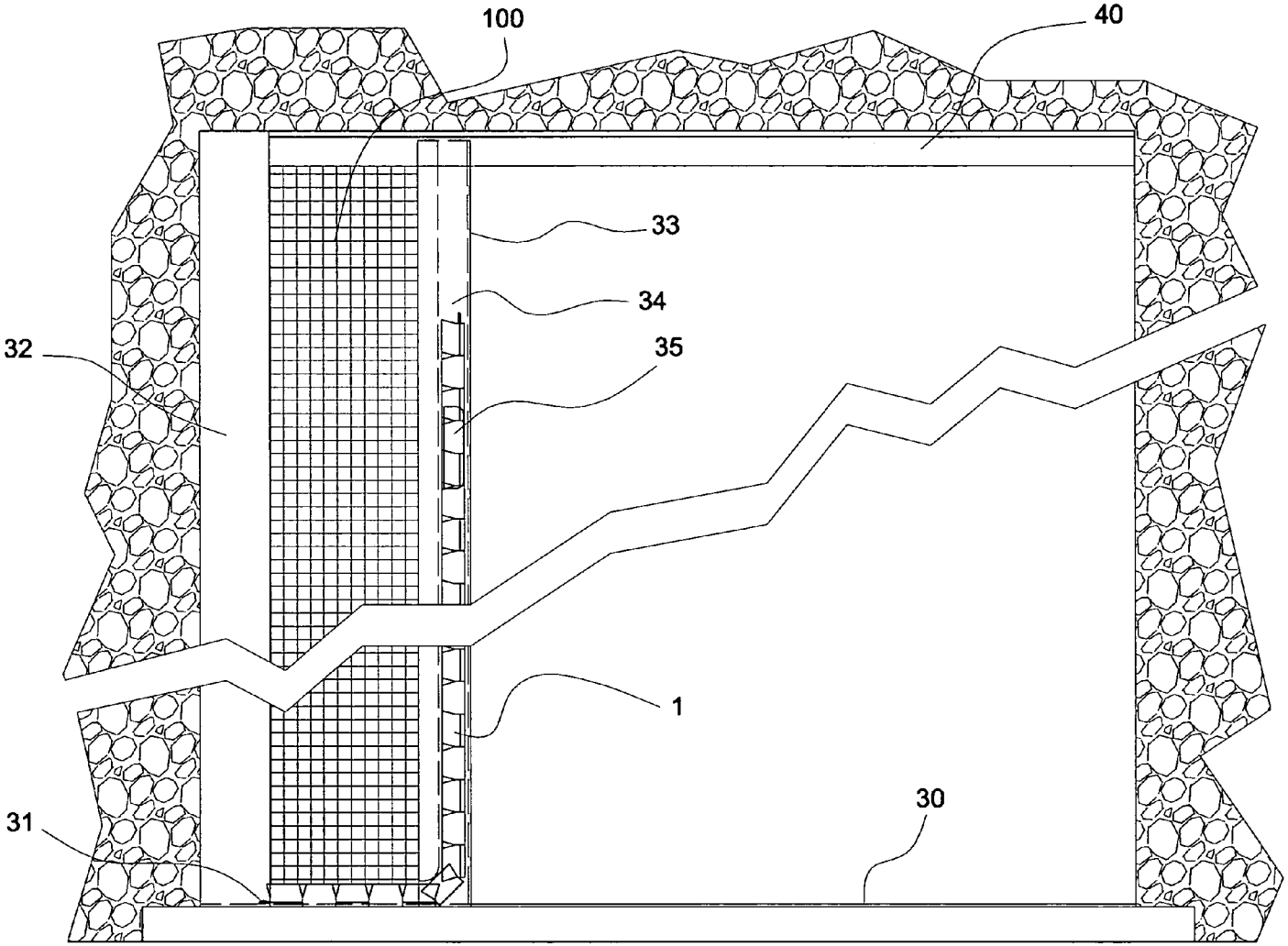

In substance, the links 2*a* exhibit a substantially U-shaped conformation when viewed in section, in order to be able to house the mosquito net 100 between the two flanks (FIGS. 8, 9).

Each link 2*b* exhibits the same conformation as the other link 2*a*, with the exception of the external gauge of the walls 5*b* which must be smaller than the internal gauge of the walls 5*a* of the link 2*a*.

In particular, the seating 4 through which the strap element 3 passes is afforded in proximity of the base of the flanks 5*a*, 5*b*, and is defined inferiorly by the connecting element 6 and superiorly, with respect to the strap element 3, by a pair of opposite and parallel beads 7 projecting from the flanks 5*a*, 5*b* and facing towards the inside of the link 2*a*, 2*b* (FIGS. 6, 7).

Figure 4:
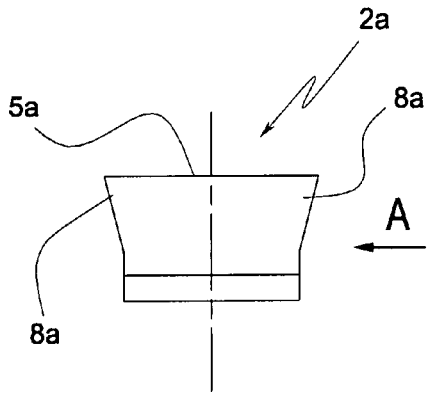
FIGS. 4 and 5 are a view of a single link of the guide of FIG. 1.
Figure 5:
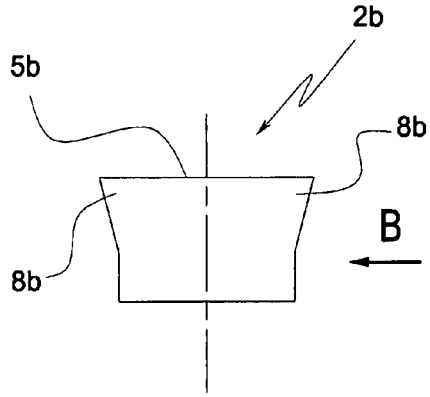

Each flank 5*a*, 5*b* exhibits a substantially trapezoid conformation having the bases thereof arranged parallel to the strap element 3, with the smaller base in proximity of the seating 4 and therefore close to the strap element 3 itself. This trapezoid conformation also makes available two identical triangular lateral fins 8*a*, 8*b* (FIGS. 4, 5).

As previously mentioned, in order to enable the guide 1 to bend, the distance between the flanks 5*a* of the links 2*a* of the first series is greater than the distance between the flanks 5*b* of the links 2*b* of the second series, so that the fins 8*b* of the flanks 5*b* of the links 2*b* of the second series can be interposed between the fins 8*a* of the flanks 5*a* of the links 2*a* of the first series.

In substance, and as can be seen in FIGS. 1-3, the free opposite ends of the connecting portions 6 strike against one another in order to form the chain, while the fins 8*a*, 8*b* of the flanks 5*a*, 5*b* superpose one another, touching each other laterally.

This prevents, in the presence of non-excessive pushing forces, reciprocal articulating of the links 2*a*, 2*b* on a perpendicular plane to the flanks 5*a*, 5*b*, and only permits articulation on a parallel plane to the flanks 5*a*, 5*b*.

Further, as the minimum bending angle obtainable with the guide 1 is determined by the angle which the fins 8*a*, 8*b* form with the plane of the connecting element 6, when the above-mentioned angle changes, the minimum bending angle of the guides 1 also changes. In particular, for fins 8*a*, 8*b* which project by a small amount, thus forming small angles with the plane of the connecting element 6, minimum bends of the guide 1 close to 90° are obtained.

Additionally, along the guide 1 each link 2*a*, 2*b* can bend with respect to the adjacent link 2*a*, 2*b* by an angle of close to 90°, enabling the guide to wind about itself.

In a preferred embodiment of the present invention, each link 2*a*, 2*b* is further provided with a pair of ribs 9, arranged opposite and parallel to the flanks 5*a*, 5*b*, which ribs 9 are arranged pointing downwards starting from the connecting portion 6. The ribs 9 cooperate with the flanks of a guide rail 30 afforded on the bottom side of the door-window (FIG. 9).

The further embodiment of FIGS. 10 and 11 comprises a single chain link 200 exhibiting two parallel flanks 205 joined by a connecting portion 206 arranged perpendicular to and interposed between the flanks 205 at the base thereof. In substance, the links 200 exhibit a substantially U-shaped conformation if viewed in section, in order to receive, between the two flanks, a mosquito net 100, as in the previously-described embodiment.

In particular, the seating 204 through which the strap element 203 passes is afforded in proximity of the base of the flanks 205 and is inferiorly defined by the connecting element 206 and superiorly, with respect to the strap element 203, by a pair of parallel and opposite beads 207 starting from the flanks 205 and facing internally of the link 200 (FIGS. 10, 11).

The seating 204 in this embodiment is arranged asymmetrically, in order that when two links are arranged adjacently, one following another, but rotated by 180°, the flanks 205 of the first link are arranged adjacently and both on a same side of the flanks 205 of the second link, thus enabling the links to co-penetrate each other and enabling the chain to curve.

In substance the plane of symmetry of the seating 204 is displaced with respect to the plane of symmetry of the flanks 205 by a quantity which is at least equal to the thickness s of the flanks 205 themselves.

Each flank 205 exhibits a substantially trapezoid conformation having the bases thereof arranged parallel to the strap element 203, with the smaller base close to the seating 204 and therefore to the strap 203. This trapezoid conformation also makes available two identical triangular lateral fins 208 (FIGS. 10, 11).

Finally, each link 200 is provided with a pair of ribs 209, parallel and opposite to the flanks 205, which develop downwards from the connecting portion 206, and are destined to cooperate with the flanks of a guide rail 30 afforded in the bottom side of the door-window.

The functioning of the two embodiments is substantially identical, and is here described in detail only in relation to the first embodiment.

Operatively, once the guide has been assembled by inserting the strap 3 into the seatings 4 of the links 2*a* alternated with the links 2*b* in order to form a single chain, an end of the strap 3 is fixed stably by means of a block 31 at the bottom of the base of a roller box 32, while the free end with the links is inserted into a shaped receiving cavity 34 specially made in an activating bar 33 provided with a handle 35, which can receive the guide in its entirety.

Naturally the links 2*a*, 2*b* of the guide 1 are blocked slidingly in proximity of the free end of the strap 3 in order to prevent them from slipping out.

When the net 100 is completely extended, fully unwound from a roller housed inside the roller box 32, thus covering the door-window opening (FIG. 8), the guide 1 rests on the rail 30 for the whole length of the opening, except for a few links which remain threaded in the cavity 34 and the bar 33.

When the mosquito net is to be opened, by displacing the bar 33 towards the left in FIG. 9, the guide 1 rises once more into the cavity 34 of the bar 33, freeing the base of the opening.

In substance, the guide 1 remains stationary in relation to the roller box 32 and extends over the base of the opening as the bar 33 progressively distances from the roller box 32 to cover the opening.

When the bar 33 is pushed in a closing direction towards the right (FIG. 8), the guide 1 slides out of the cavity 34 and extends onto the base of the opening, making available the space between the pairs of 5*a*, 5*b* of the links 2*a*, 2*b*, to progressively receive the bottom edge of the net 100.

The upper edge of the net 100 is received in a guide 40 in which the upper end of the bar 33 runs, the guide 40 being fixed on the upper crosspiece of the door-window.

As can be appreciated from the foregoing, the flexible guide for a mosquito net of the present invention enables the needs to be satisfied and obviates the drawbacks mentioned in the introductory part of the present description with reference to the prior art.

The flexible guide of the present invention is simple to produce and to assemble.

Further, thanks to the special conformation of the links and to the presence of the flexible strap element, the flexible guide can be curved up until it forms small angles of close to 90°, consequently requiring a simple realisation of the receiving cavity within the sliding bar of a mosquito net assembly.

Obviously an expert in the sector, with the objective of meeting specific and contingent requirements, might make numerous modification and variations to the flexible guide for a mosquito net of the invention, all contained within the ambit of protection of the invention, as defined in the following claims.

The invention claimed is:

1. An apparatus comprising a flexible guide (1) and a mosquito net (100), wherein said flexible guide (1) is fixable to a window opening and comprises:

a plurality of rigid adjacent links (2*a*, 2*b*, 200), each link (2*a*, 2*b* 200) includes two flanks (5*a*, 5*b*, 205) that are opposite to each other and which receives the mosquito net between them, and a connecting portion (6, 206) arranged transversally to the flanks (5*a*, 5*b*) and fixed to the flanks (5*a*, 5*b*), wherein each link (2*a*, 2*b*, 200) is provided with a seating (4, 204) for receiving a flexible strap element (3, 230) in order to form, with adjacently-situated links (2*a*, 2*b*, 200), a single chain, wherein each flank (5*a*, 5*b*) has two identical triangular lateral fins (8*a*, 8*b*) disposed opposite each other at opposite ends of each flank (5*a*, 5*b*), and each link (2*a*, 2*b*, 200) of the guide (1) co-penetrates into an adjacent link (2*a*, 2*b*, 200), by an arrangement in which the fins of the flanks of one of said adjacent links (2*a*, 2*b*, 200) are interposed between and laterally touching the fins of the flanks of the adjacent link, so that each link (2*a*, 2*b*, 200) is able to rotate with respect to the adjacent link (2*a*, 2*b*, 200) by an angle close to 90 degrees.

2. The apparatus of claim 1, wherein the flanks (5*a*, 5*b*, 205) are arranged parallel to one another.

3. The apparatus of claim 2, wherein the connecting portion (6, 206) is arranged perpendicular to the corresponding flanks (5*a*, 5*b*, 205).

4. The apparatus of claim 1, wherein the seating (4, 204) is located in proximity to the connecting portion (6, 206).

5. The guide (1) of claim 4, wherein a lower portion of apparatus of claim 4, wherein a lower portion of the seating (4, 204) is defined by the connecting element (6, 206) and an upper portion of the seating (4, 204) is defined by a pair of opposite beads (7, 207), wherein the pair of opposite beads (7, 207) emerge from the flanks (5*a*, 5*b*, 205) and progress towards the inside of the links (2*a*, 2*b*, 200).

6. The apparatus of claim 3, wherein the flanks (5*a*, 5*b*, 205) of each pair are identical and have a larger base and a smaller base, said bases being parallel to a longitudinal extension of the seating (4, 204), the smaller base of the bases being close to the seating (4, 204).

7. The apparatus of claim 6, wherein the plurality of links (2*a*, 2*b*) is formed by a first series of first links (2*a*) alternated with a second series of second links (2*b*).

8. The apparatus of claim 7, wherein a distance between the flanks (5*a*) of the links (2*a*) of the first series of links is greater than a distance between the flanks (5*b*) of the links (2*b*) of the second series of links, in order that portions (8*b*) of the flanks (5*b*) of the links (2*b*) of the second series are capable of being interposed between corresponding portions (8*a*) afforded on the flanks (5*a*) of the links (2*a*) of the first series of links.

9. The apparatus of claim 8, wherein the flanks (5*a*, 5*b*) of the links (2*a*, 2*b*) of the first and the second series of links are arranged in such a way as partially to slide slippingly over on one another when the strap element (3) is bent.

10. The apparatus of claim 1, wherein each link (2*a*, 2*b*, 200) exhibits a pair of ribs (9, 209) arranged parallel to and opposite to the flanks (5*a*, 5*b*, 205), with the connecting portion (6) interposed therebetween, the pair of ribs (9, 209) being destined to cooperate with a guide rail (30) located on a threshold of the window opening to be closed by the mosquito net (100).

11. The apparatus of claim 1, wherein the seating (204) is arranged asymmetrically with respect to the flanks (205) so that when two links (2*a*, 2*b*) are arranged adjacent to one another, but reciprocally angled by 180 degrees, the flanks (205) of a link are arranged adjacent and both on a same side of the flanks of the adjacent link.

12. The apparatus of claim 1, wherein the strap element (3, 203) is made of a non-stretch material.

13. The apparatus of claim 1, wherein the connecting portion joining the two flanks of each link is separate from the connecting portion of any adjacent link.

14. The apparatus of claim 1, wherein each link co-penetrates into an adjacent link even when the guide is straight.

15. An apparatus comprising a flexible guide (1) and a mosquito net (100), wherein said flexible guide (1) is fixable to a window opening and comprises:

a plurality of rigid adjacent links (2*a*, 2*b*, 200), each link (2*a*, 2*b* 200) includes two flanks (5*a*, 5*b*, 205) that are opposite to each other and which receives the mosquito net between them, and a connecting portion (6, 206) arranged transversally to the flanks (5*a*, 5*b*) and fixed to the flanks (5*a*, 5*b*), wherein each link (2*a*, 2*b*, 200) is provided with a seating (4, 204) for receiving a flexible strap element (3, 230) in order to form, with adjacently-situated links (2*a*, 2*b*, 200), a single chain and the plane of symmetry of the seating is displaced with respect to the plane of symmetry of the flanks by a quantity which is at least equal to the thickness of the flanks themselves, and wherein each link (2*a*, 2*b*, 200) of the guide (1) co-penetrates into its adjacent link (2*a*, 2*b*, 200) and is able to rotate with respect to its adjacent link (2*a*, 2*b*, 200) by an angle close to 90° each link (2*a*, 2*b*, 200) of the guide (1) co-penetrates into an adjacent link (2*a*, 2*b*, 200), by an arrangement in which the fins of the flanks of one of said adjacent links (2*a*, 2*b*, 200) are interposed between and laterally touching the fins of the flanks of the adjacent link, so that each link (2*a*, 2*b*, 200) is able to rotate with respect to the adjacent link (2*a*, 2*b*, 200) by an angle close to 90 degrees.

* * * * *